US005681000A

United States Patent [19]

Göbbels et al.

[11] Patent Number: 5,681,000

[45] Date of Patent: Oct. 28, 1997

[54] SERVICING APPARATUS FOR A YARN PACKAGE-PRODUCING TEXTILE MACHINE

[75] Inventors: Heinz-Dieter Göbbels, Mönchengladbach; Stephan Kaspers, Viersen; Hans-Willi Esser, Mönchengladbach, all of Germany

[73] Assignee: W. Schlafhorst AG & Co., Moenchengladbach, Germany

[21] Appl. No.: 523,188

[22] Filed: Sep. 5, 1995

[30] Foreign Application Priority Data

Sep. 14, 1994 [DE] Germany ..... 44 32 702.1

[51] Int. Cl.[6] ..... B65H 54/00; B65H 59/22; D01H 9/14

[52] U.S. Cl. ..... 242/18 PW; 57/269; 57/278; 242/18 EW; 242/150 R

[58] Field of Search ..... 242/35.5 A, 18 EW, 242/18 PW, 18 R, 35.6 R, 150 R; 57/278, 269, 270

[56] References Cited

U.S. PATENT DOCUMENTS

| | | | |
|---|---|---|---|
| 3,642,216 | 2/1972 | Abbot | 242/35.6 R X |
| 4,324,368 | 4/1982 | Inouye et al. | 242/18 PW |
| 4,489,898 | 12/1984 | Cardell | 242/18 PW |
| 4,550,880 | 11/1985 | Niederer et al. | 242/18 PW X |
| 4,565,331 | 1/1986 | Matsubara et al. | 242/18 PW |
| 5,159,804 | 11/1992 | Schippers et al. | 242/35.6 R X |
| 5,165,615 | 11/1992 | Polnik | 242/35.5 A |
| 5,246,178 | 9/1993 | Badiali et al. | 242/18 PW |
| 5,330,115 | 7/1994 | Mayer et al. | 242/18 PW |
| 5,473,879 | 12/1995 | Gobbels et al. | 57/269 X |
| 5,495,991 | 3/1996 | Raasch et al. | 242/35.5 A |

FOREIGN PATENT DOCUMENTS

| | | |
|---|---|---|
| 0106809B1 | 7/1983 | European Pat. Off. . |
| 0203508B1 | 7/1990 | European Pat. Off. . |
| 0311987B1 | 11/1991 | European Pat. Off. . |
| AS2302095 | 4/1974 | Germany . |
| 3436025A1 | 4/1985 | Germany . |
| 3831341A1 | 4/1989 | Germany . |
| 3801965A1 | 7/1989 | Germany . |
| 2615909C2 | 10/1989 | Germany . |
| 3930136A1 | 3/1991 | Germany . |
| 4033960A1 | 5/1991 | Germany . |

*Primary Examiner*—Michael Mansen
*Attorney, Agent, or Firm*—Shefte, Pinckney & Sawyer

[57] ABSTRACT

A servicing apparatus for automatic repair of yarn breaks in open-end spinning machines is provided with a device for replacing finished yarn packages with empty tubes, and a multi-functional yarn manipulating element having a work head equipped with a yarn brake and a contoured yarn guide element, the manipulating element being selectively movable between a position (c) at a top end of the tube for forming a top winding at the completion of winding a full yarn package, a position (a) at a base end of the tube for forming a yarn reserve winding upon beginning the winding of an empty tube, and a position (b) moving axially along the tube to prevent the creation of parallel windings during the repair of a yarn break.

12 Claims, 8 Drawing Sheets

SERVICING APPARATUS FOR A YARN PACKAGE-PRODUCING TEXTILE MACHINE

SUMMARY OF THE INVENTION

The present invention relates to a yarn package-producing textile machine, having a servicing apparatus for automatically repairing yarn breaks that occur during bobbin winding and for replacing finished yarn packages, or cross-wound bobbins, with empty tubes.

BACKGROUND OF THE INVENTION

Various automatic servicing devices or units for open-end spinning machines are known, which operate when a yarn break occurs to first clean the spinning element and then splice or otherwise piece the yarn using a yarn end removed by suction from a yarn package held in the creel of the spinning station. These known, time-tested piecing units cooperate with special yarn package-changing devices, which assure that finished yarn packages will be replaced with starter tubes. The starter tubes, which are transferred by the changing device to the creel of the spinning station, already contain a certain quantity of yarn that the piecing unit needs for repiecing.

Service units that can both repair "normal" yarn breaks and carry out yarn package replacement are also known from the following patents: DE 38 01 965 A1, EP 0 106 809 B, EP 0 203 508 B, or EP 0 311 987 B.

These known service devices have special yarn piecing units and a cop changer in addition to a pneumatic or mechanical auxiliary yarn transport device. The service apparatus of DE 38 01 965 A1 also has a device for forming a top winding. This device is disposed in the region of the yarn locating nozzle and makes it possible, at the end of package winding, to wind the end of the yarn from the finished yarn package onto the tube next to the yarn package, so that the yarn end is readily accessible in a subsequent production operation.

SUMMARY OF THE INVENTION

While the known servicers have proven themselves in practice, they nevertheless have various disadvantages. The object of the invention is to further improve the known automatic servicing apparatus of the types described above.

This object is attained in accordance with the present invention by a servicing apparatus adapted to be combined with a textile machine for producing yarn packages by winding yarn onto a supporting tube driven by a winding drum, wherein the servicing apparatus is equipped for automatic repair of yarn breaks that occur during package formation and for replacing finished packages with empty tubes. In accordance with the present invention, the servicing apparatus comprises a yarn manipulating element having a work head and an associated drive for selective movement of the work head parallel to the winding drum between a first position in the region of a base end of the tube for forming initial bottom windings thereon during yarn transfer to an empty tube, a second position adjacent the surface of wound yarn on the tube during repair of a yarn break, and a third position in the region of a top end of the tube for forming top windings on a fully wound tube.

The multi-function element, which is relatively simple in its design and structure, offers the advantage that various yarn manipulations by the servicing apparatus can be optimized without major additional effort or expense.

An advantageous feature is the provision of the multi-function element with a work head, disposed by an end thereof on the piston rod of a pneumatic thrust piston and equipped with a specially contoured yarn guide element and a yarn brake. The multi-function element is embodied and positioned in such a way that the work head is displaceable in a defined manner parallel to the axis of the winding drum, over the entire tube length of a yarn package held in the creel.

The contoured yarn guide element has an inclined yarn take-up face in its upper region, which, in the extension direction of the thrust piston operation, allows the guide element to be placed under the strand of yarn that extends between the yarn package and a yarn locating nozzle. In the lower region of the yarn guide element, a forward-protruding guide extension is provided to prevent, when needed, the strand of yarn extending between the yarn package and the yarn draw-off device of the servicing apparatus from sliding off during the crosswise shifting of the yarn. The yarn brake in a preferred embodiment has two relatively clampable brake elements, at least one of which can be acted upon by a spring element. The yarn brake is thrust over the strand of yarn if needed to impose additional tension on the yarn.

The described embodiment of the contoured yarn guide element according to the invention makes it possible for a newly pieced yarn, which has not yet been threaded into the traversing device of the particular winding station, to be guided in such a way that the yarn is shifted laterally in a defined way during the run-up phase of the work station, and makes it possible to form so-called, bottom starter windings of the yarn. The vertical region of the yarn guide face of the contoured yarn guide element then engages the strand of yarn extending between the yarn draw-off device of the servicing apparatus and the yarn package and shifts it toward one end face of the yarn package. In this way, undesired parallel windings on the yarn package can be reliably avoided.

The advantageous embodiment of the work head of the multi-function element also enables the formation of a so-called top yarn package winding at the completion of a full package winding. The work head or the yarn guide element has an inclined region of its yarn guide face that initially slides under the yarn end extending between the yarn package and the yarn locating nozzle. Next, the yarn end, now positioned behind the contoured yarn guide element, is guided by the multi-function element moving in reverse, while the yarn package is rotated in the winding direction of the yarn package, causing the yarn to be wound onto the free end of the tube next to the previously wound yarn package.

Another object is attained by the multi-function element during transfer of the newly pieced yarn to an empty tube, i.e., at the beginning of package winding when the so-called bottom winding is made. Since at that moment the yarn lacks the necessary tension for making a satisfactory bottom winding, additional yarn tension is induced in the yarn temporarily by the yarn brake disposed on the work head of the multi-function element.

DESCRIPTION OF THE PREFERRED EMBODIMENT

Figure 1:
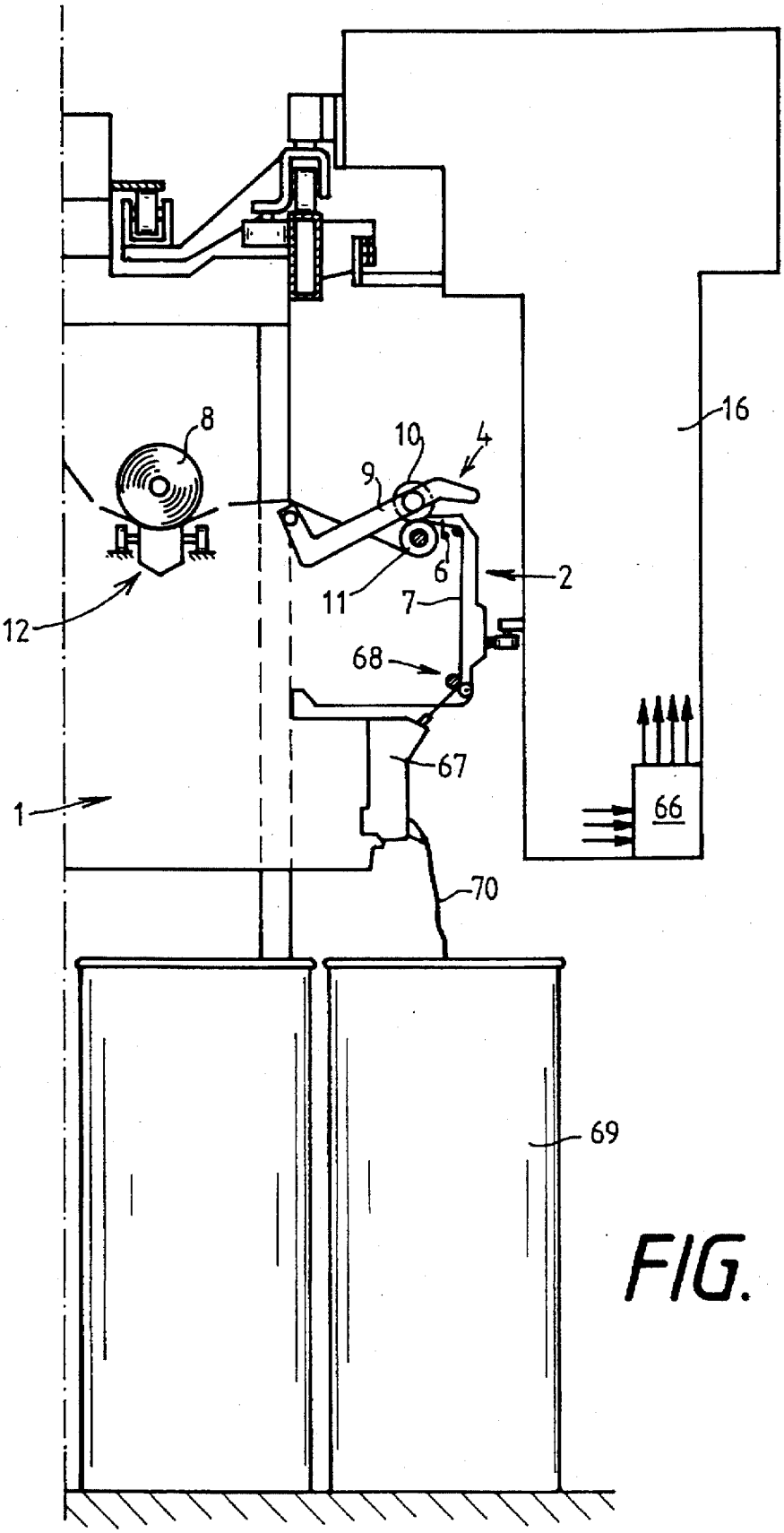
FIG. 1 is an endwise elevational view of one side of an open-end spinning machine, with a servicing apparatus patrolling along the spinning machine.

In FIG. 1, one side of a conventional form of open-end spinning machine is indicated by reference numeral 1. Spinning machines of this kind have many work stations 2, which are each equipped with both a spinning box 67 and a winding device 4. In each of the spinning boxes 67, a sliver 70, delivered from spinning cans 69, is spun into a yarn 7, which is then wound by the associated winding device 4 to form a cross-wound bobbin or yarn package 8. As shown, each winding device 4 is equipped with a creel 9 for rotatably holding an empty tube 10 or a yarn package 8 and a winding drum 11.

The open-end spinning machine 1 also has a lengthwise-traveling bobbin transport device 12 for supplying the work stations of the spinning machine with empty tubes and for receiving the finished yarn packages for removal from the machine.

A servicing apparatus 16 is disposed on or at the spinning machine 1 for movement along the work stations of the machine on guide rails. Such servicing apparatus patrols constantly along the open-end spinning machine 1 and intervenes automatically if some need for service occurs at one of the work stations 2. An example of such a need is if a yarn break has occurred at a work station 2, or if a yarn package being wound at one of the work stations has reached its prescribed diameter and must be replaced with an empty tube.

In such a case, the servicing apparatus 16 travels to the work station involved and positions itself in proper relation to the operating components of the station. If a "normal" yarn break has occurred, the servicing apparatus searches with its yarn locating nozzle 21 for the broken trailing end of the yarn resting on or extending from the circumferential surface of the yarn package 8. After the spinning box 67 has been cleaned, the yarn end is reinserted into the spinning box and repieced to a fiber ring extending about the spinning chamber ( commonly a spinning rotor) to resume the open-end spinning process.

The operation proves to be somewhat more difficult if the yarn package being wound is fully wound and therefore first has to be replaced with an empty tube prior to performing a piecing-up of the yarn into the spinning box 67.

Figure 2:
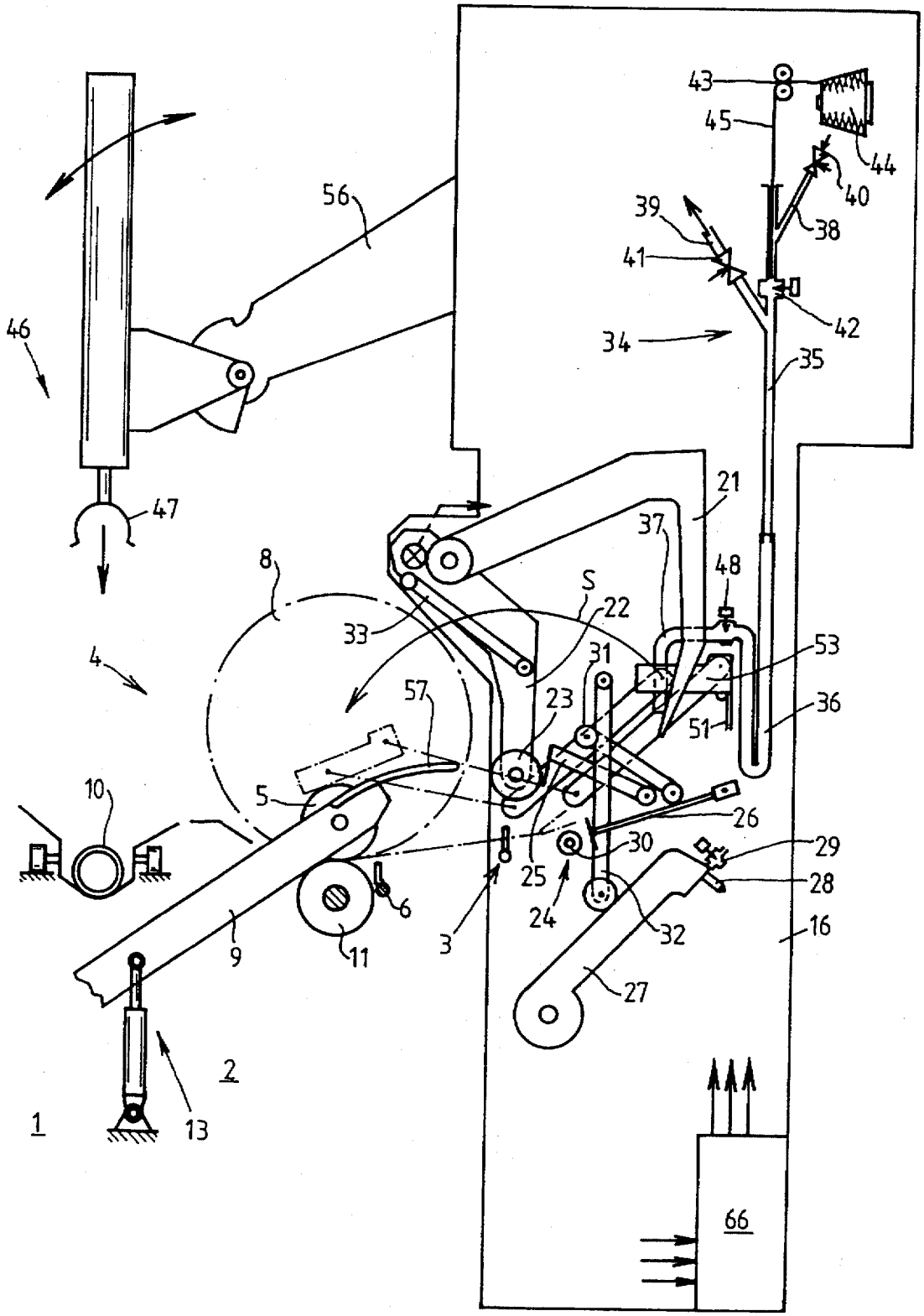
FIG. 2 is a schematic endwise elevational view of one winding station of the open-end spinning apparatus, depicting the servicing apparatus with a multi-function element according to the invention positioned in front of the winding station.

FIG. 2 schematically shows a winding device, identified overall by reference numeral 4, at one work station 2 of an open-end spinning machine 1. Winding devices 4 of this kind have a creel 9 having a pair of arms equipped with facing tube support plates between which the tube 10 of a yarn package 8 is rotatably held for winding of yarn thereon. The yarn package 8 rests with its circumferential surface on a driven winding drum 11 to be driven by frictional engagement. A traversing yarn guide device 6 disposed to reciprocably traverse alongside the winding drum 11 assures that the yarn 7 will be wound onto the yarn package 8 in intersecting, i.e., cross-wound, layers.

Figure 3:
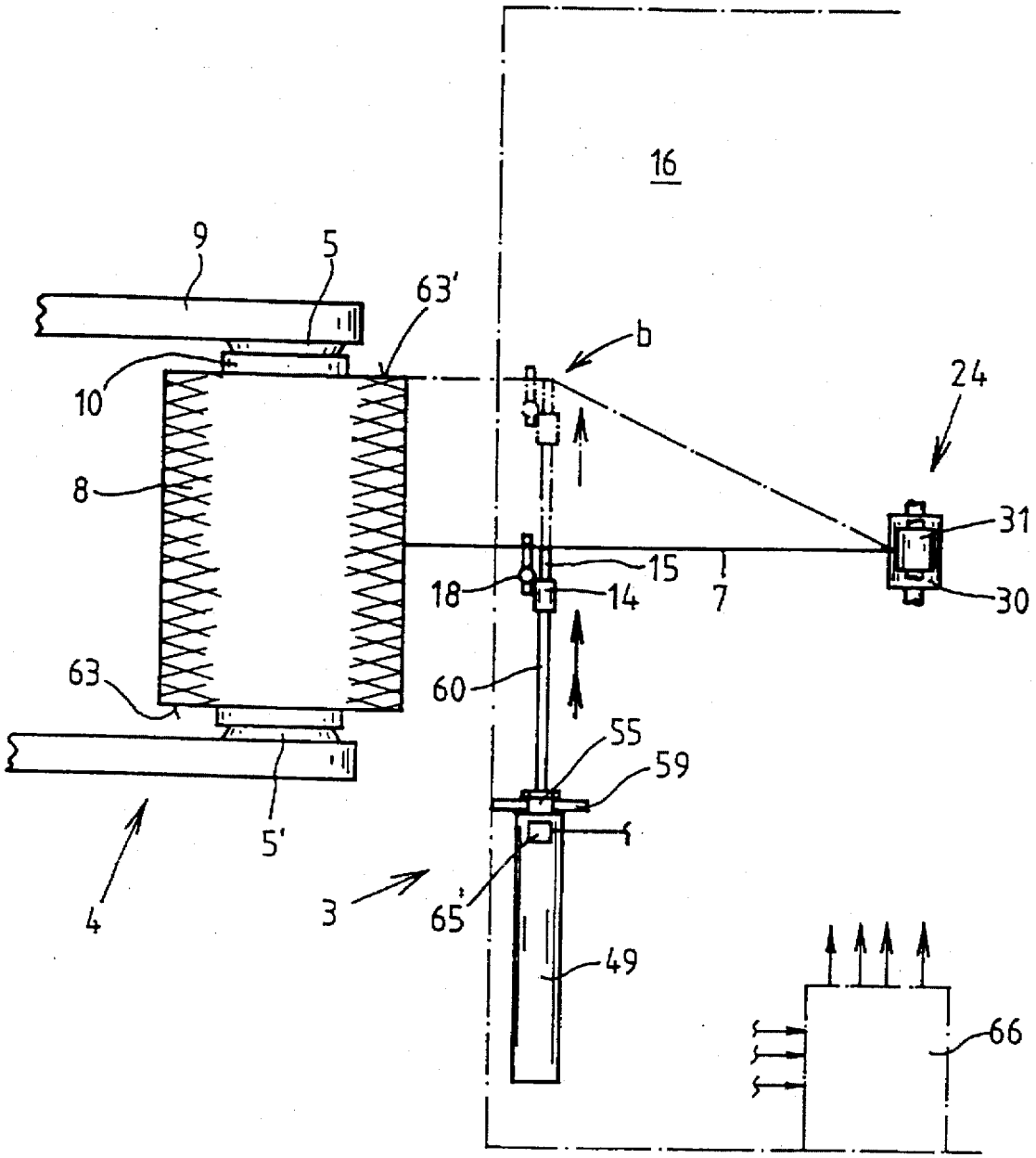
FIG. 3 is a plan view of the multi-function element in the process of repairing a yarn break.
Figure 8:
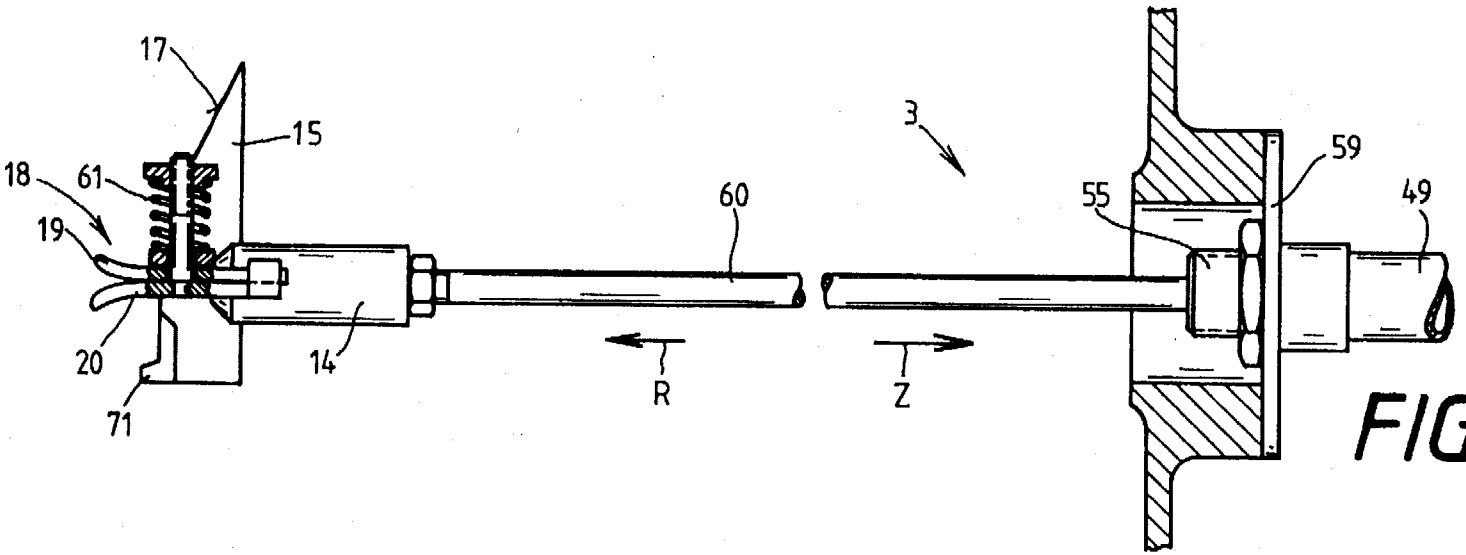
FIG. 8 is a side view of the work head of the multi-function element.
Figure 9:
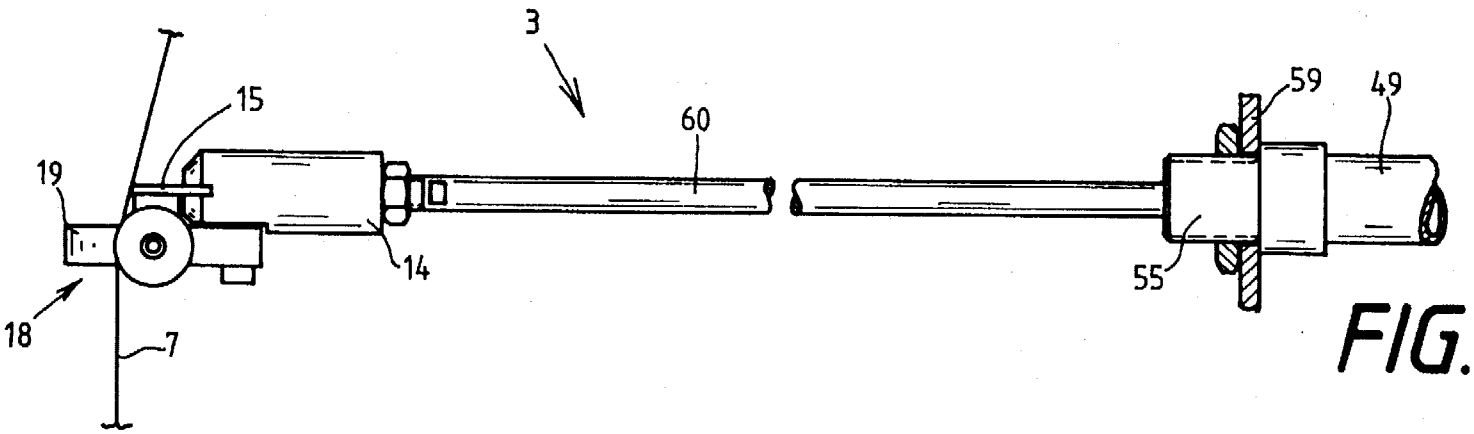
FIG. 9 is a plan view of the work head of the multi-function element.

A servicing apparatus 16 is positioned in front of the winding device 4, its most important working elements being schematically illustrated. According to one important aspect of the invention, the servicing apparatus 16 is equipped with a yarn manipulating device 3, which is also referred to herein as a yarn manipulating element 3, capable of performing a plurality of functions which will be described later. As seen in FIG. 3, the yarn manipulating device includes a cylinder 49 mounted to the servicing apparatus 16 using a bracket 59. An extensible shaft 60 is slidably disposed within the cylinder 49 for bi-directional movement inwardly and outwardly of the cylinder 49. The extensible shaft 60 is fixed to a piston (not shown) contained within the cylinder 49. The assembly is retained in an assembled state by a collar 55 attached to the cylinder 49 adjacent an opening through which the shaft 60 projects. This relationship is also seen in FIGS. 8 and 9. Otherwise, the servicing apparatus 16 is essentially of the same basic construction and operation as that disclosed in U.S. patent application Ser. No. 08/232,829, filed Apr. 22, 1994, entitled OPEN-END SPINNING MACHINE FOR PRODUCING CROSS-WOUND BOBBINS which issued as U.S. Pat. No. 5,473,879 on Dec. 12, 1995, the disclosure of which is incorporated herein by reference. In particular, the servicing apparatus has a pivotable yarn locating nozzle 21 having a yarn aspiration slit connected to a source of suction for picking up torn yarn ends when placed against the outer circumference of the yarn package 8. The servicing apparatus also has an expulsion and drive arm 22 on whose end is a drive roller 23.

The drive roller 23, which can be acted upon by a drive motor (not shown), can be disconnected from the drive motor via an electric clutch. An angle encoder is also disposed on the drive arm 22 and enables monitoring of the position of the drive arm at any given time. The servicing apparatus 16 is also equipped with a yarn catch plate 25, a yarn threader 26, a yarn feeder 27 with feeder tongs 28, and a yarn cutter 29 as well as a controllable yarn draw-off device 24, all of which are known. The yarn draw-off device 24 comprises a draw-off roller 30 and a pivotably disposed pressure roller 31.

Other control elements built into the servicing apparatus 16 are a frame opener 32, a pressure lever 33, and an auxiliary yarn transporter 34. This auxiliary yarn transporter 34 substantially comprises a tube system 35, which communicates via a flexible connecting element 36, such as a flexible hose, with a supply tube 37 that can be pivoted into various working positions. The supply tube 37 is secured to a supply tube retainer 53, which can be pivoted into various work positions via parallelogram links. The tube system 35, into which auxiliary yarn 45 drawn from a supply bobbin 44 is fed via a yarn supply mechanism 43, also has a compressed air connection 38, in which an injector nozzle is installed, and a suction connection 39. The air connections 38, 39 can each be selectively opened and closed in a defined manner via respective valves 40 and 41. A yarn cutter 42 is also disposed inside the tube system 35.

The servicing apparatus 16 also has a tube gripper 46 mounted on a bracket 56 disposed at the upper end of the servicing apparatus structure, the tube gripper 46 having a gripper element 47 adapted to the outer diameter of the empty tubes 10, which as aforementioned are fed to the region of the work stations 2 via the bobbin and tube transport device 12.

The detailed operation of the servicing apparatus may thus be understood. The servicing apparatus 16 stops at and positions itself relative to a work station requiring yarn piecing service whenever the servicing apparatus 16 detects an appropriate signal at a work station while patrolling along the machine, e.g., a signal light transmitted by the work station 2, or has been informed by receipt of a signal from a data transmission system of the open-end spinning machine that an intervention is necessary at a work station, whereupon the servicing apparatus 16 travels to that work station. Next, the servicing apparatus 16 either determines by its own detection system what service is needed at the affected work station, such as repairing a "normal" yarn break or a yarn package that needs changing, or else the reason for the service signal is imparted to the control system 66 of the servicing apparatus 16 via the data transmission system of the open-end spinning machine. Depending on the situation involved, appropriate programs, stored in the memory of the control system 66, for carrying out the various sequences of the necessary service operation are then started.

Figure 4:
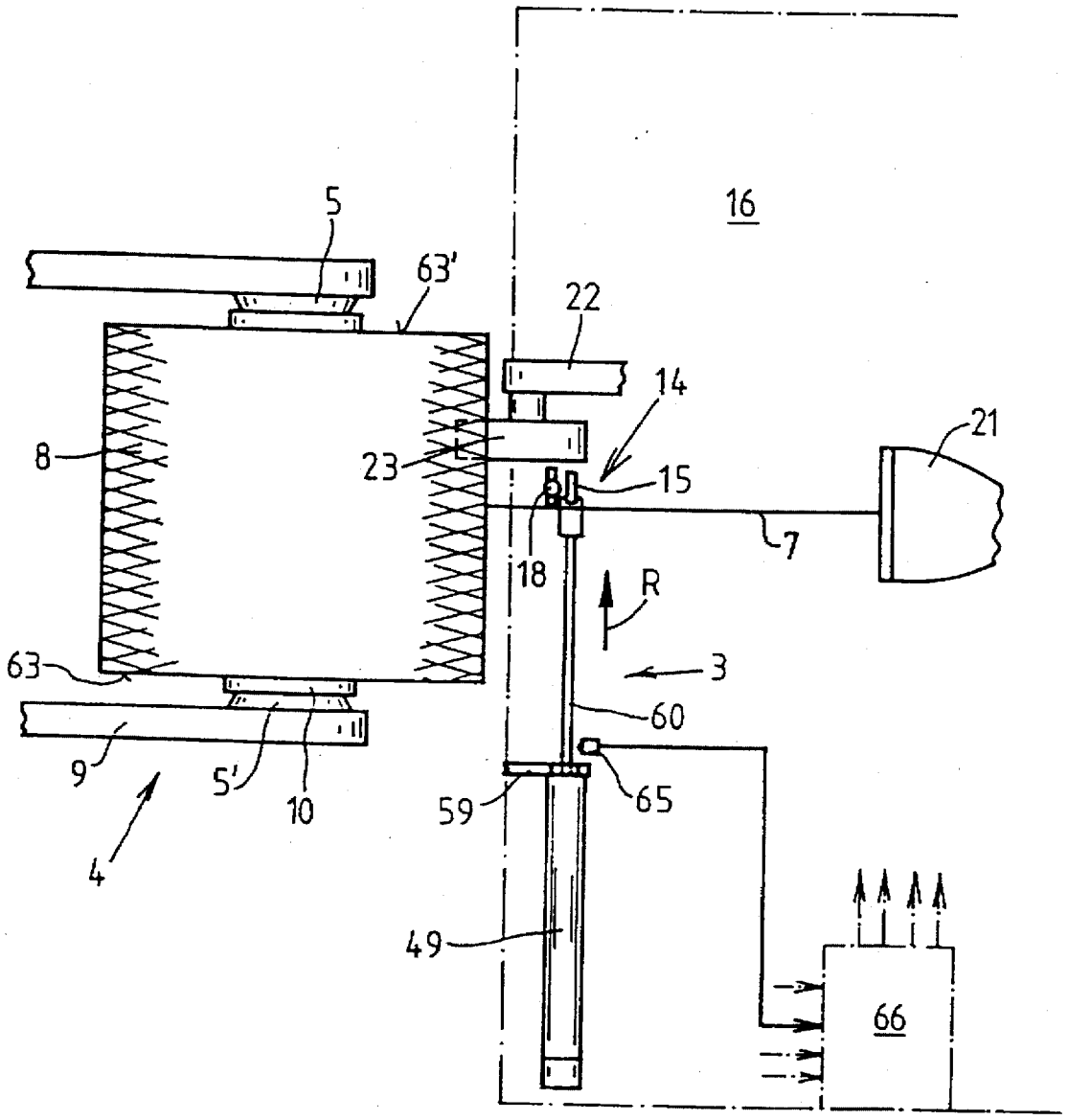
FIGS. 4 is a plan view similar to FIG. 3, showing the multi-function element as it makes a top winding.
Figure 5:
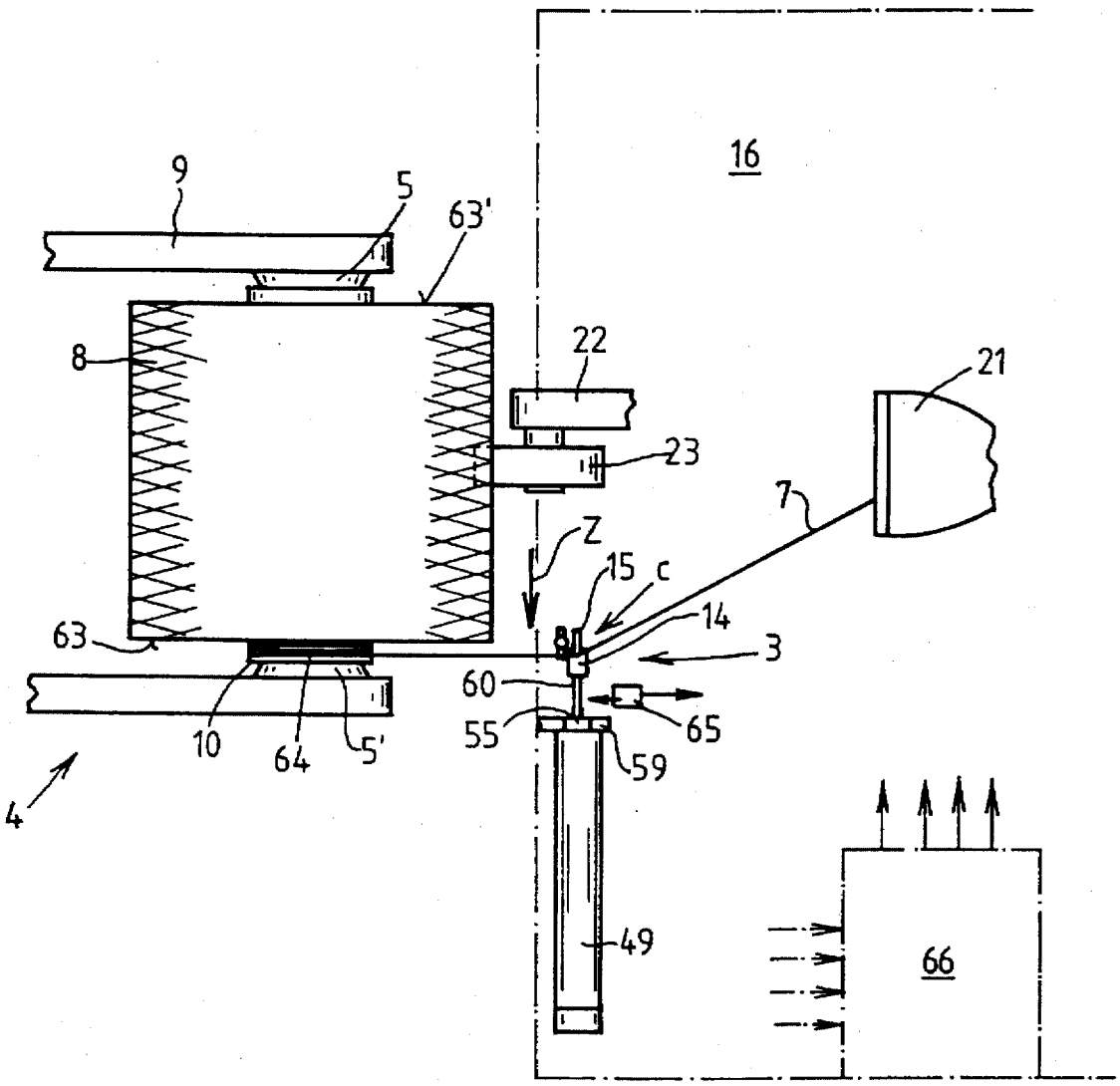
FIG. 5 is a plan similar to FIG. 3, showing the multi-function element as it makes a top winding.

For instance, if the servicing apparatus 16 is called to a work station where a yarn package 8 that has reached its maximum diameter is to be replaced with an empty tube, the following program sequence results:

First, as shown in FIGS. 4 and 5, the expulsion and drive arm 22 is pivoted outward in the direction of the yarn package 8 to bring its drive roller 23 into contact against the outer surface of the yarn package 8. The yarn package 8 will have already beforehand been raised from the winding drum 11 during the winding operation by upward pivoting of the arms of the creel 10 by means of a piston-and-cylinder assembly 13 (FIG. 2) serving to adjust for the increasing diameter of the wound yarn as winding progresses. The yarn locating nozzle 21 is also pivoted forward from the retracted position shown in FIG. 2 into the region of the outer surface of the yarn package 8. The yarn package 8 is then rotated counter to its winding direction by means of driven rotation of the drive roller 23. In the process, the trailing end of the yarn resting on the surface of the bobbin is aspirated into the yarn locating nozzle 21. The yarn locating nozzle 21 then pivots back to its starting position, causing tensioning of the length of yarn 7 extending between the yarn package 8 and the yarn locating nozzle 21, as shown in FIG. 4. The operating head 14 of the multi-function element 3 is moved outwardly in the direction R to slide under this tensioned strand of yarn 7 by causing the yarn strand 7 to slide over an inclined yarn takeup face 17 (FIG. 8) of a contoured yarn guide element 15 carried at the outward end of the element 3, with the yarn coming to rest behind the contoured element 15. The yarn package 8 is then rotated in the winding direction once again by the drive roller 23, and simultaneously the multi-function element 3 is withdrawn inwardly in the direction Z as shown in FIG. 5. The yarn end 7 located behind the contoured yarn guide element 15 is caused to slide laterally (i.e. axially) of the outer surface of the yarn package 8 as the work head 14 of the multi-function element 3 moves into position c in FIG. 5, and is wound onto the tube 10 next to the end face 63 of wound yarn as a top winding 64.

Next, the tube gripper 46, for example embodied as a telescoping gripper, is pivoted into the position shown in FIG. 2 and extends the gripper element 47 in the direction of the tube and bobbin transport device 12 to retrieve an empty tube 10 carried thereon. The gripper element 47 disposed on the end engages over the empty tube 10 located in the tube and bobbin transport device 12, and this tube is then raised with the gripper element 47 into an upper position as the tube gripper 46 withdraws inwardly. Next, the frame opener 32 acts upon a guide extension 57 projecting from an arm of the creel 9 causing the creel arm to be forced outwardly, so that the yarn package 8 is released and can be transferred by the forward-pivoting expulsion force of the drive arm 22 of the servicing apparatus 16 into the tube and bobbin transport device 12. The drive roller 23 disposed on the end of the drive arm 22 is disengaged from its drive during this action, in order to prevent damage to the surface of the yarn package.

Both the frame opener 32 and a pressure lever 33 resting on the guide extension 57 are then actuated further to pivot the creel 9 into an empty tube transfer position, which is located a predetermined spacing above the winding drum 11 wherein the gripper element 47 transfers the empty tube to the creel 9. The proper transfer of the empty tube is monitored via an angle encoder, disposed on the drive arm 22, which detects as an error a missing or incorrectly placed empty tube 10 by recognizing a corresponding angular deviation of the drive arm 22 from a stored reference value.

A yarn piecing cycle is also started synchronously with the above-described changing operation, wherein an auxiliary yarn 45 is first drawn from the supply bobbin 44 by the yarn supply mechanism 43 and fed inside the auxiliary yarn transporter 34 to the mouth of the supply tube 37. Inside the tube system 35 of the auxiliary yarn transporter 34, the auxiliary yarn 45 is transported pneumatically, for example by means of an injector nozzle disposed in the compressed air connection 38.

The supply tube 37 at this moment is in a rearward position, shown in FIG. 2, in which the mouth region of the supply tube 37 is in the immediate vicinity of the suction slit of the yarn locating nozzle 21 of the servicing apparatus 16. The yarn locating nozzle 21 is parked in a resting position, in which the other control and operation elements disposed in the servicing apparatus are unhindered. The end of the auxiliary yarn 45 furnished via the auxiliary yarn transporter 34 emerges from the mouth of the supply tube 37 and immediately enters the operative range of the yarn locating nozzle 21 and is aspirated into it. Next, the supply tube 37 pivots into a second working position (not shown in FIG. 2 for the sake of greater simplicity) in which the mouth of the supply tube 37 is in an upward position in the pivoting path S of the yarn supply tube 37. During the pivoting operation, just enough auxiliary yarn 45 as needed in order to tension the length of auxiliary yarn between the mouth of the supply tube 37 and the yarn locating nozzle 21 is replenished by the auxiliary yarn transporter.

This tensioned length of the auxiliary yarn between the mouth of the supply tube 37 and the yarn locating nozzle 21 is now used by the yarn piecer devices of the servicing apparatus 16 for repiecing. For this purpose, the auxiliary yarn is first positioned by a yarn catch plate 25 and transferred by the yarn threader 26 to the feeder tongs of the yarn feeder 27. Next, the auxiliary yarn is cut to length by the yarn cutter 29, and the severed end of the yarn is removed by suction through the yarn locating nozzle 21. The auxiliary yarn transporter 34 is switched over to suction, and the auxiliary yarn 45 inside the tube system 35 is cut by the yarn cutter 42. The end of the auxiliary yarn engaged in the tongs 28 of the yarn feeder 27 is then transferred by the forward-pivoting yarn feeder 27 to the spinning box 67 and placed in the spinning rotor into contact with a ring formed of individual fibers in the process of being spun into yarn.

The newly pieced yarn is drawn off together with the auxiliary yarn via the draw-off roller 30 and the pressure roller 31 of the yarn draw-off device 24 and aspirated into the supply tube 37. A yarn cutter 48 and a sensor device 58 (FIG. 7) are disposed in the association with the supply tube 37. The sensor device 58 detects the splice between the auxiliary yarn 45 and the new yarn 7 entering the supply tube and thereupon initiates the yarn cutter 48, which cuts out the splice along with the auxiliary yarn.

Figure 6:
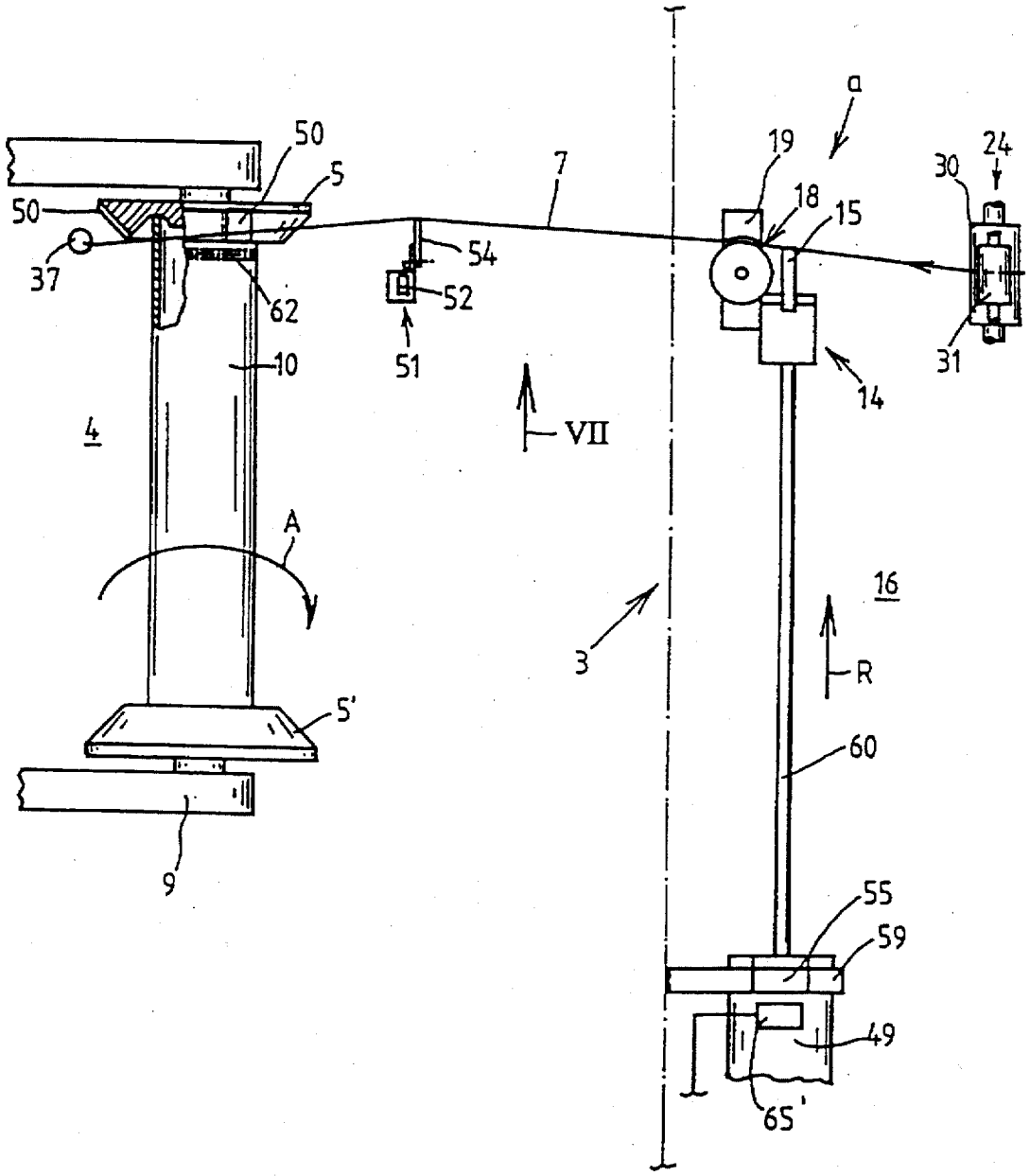
FIG. 6 is another plan view showing the multi-function element as its lays a newly pieced yarn onto an empty tube.
Figure 7:
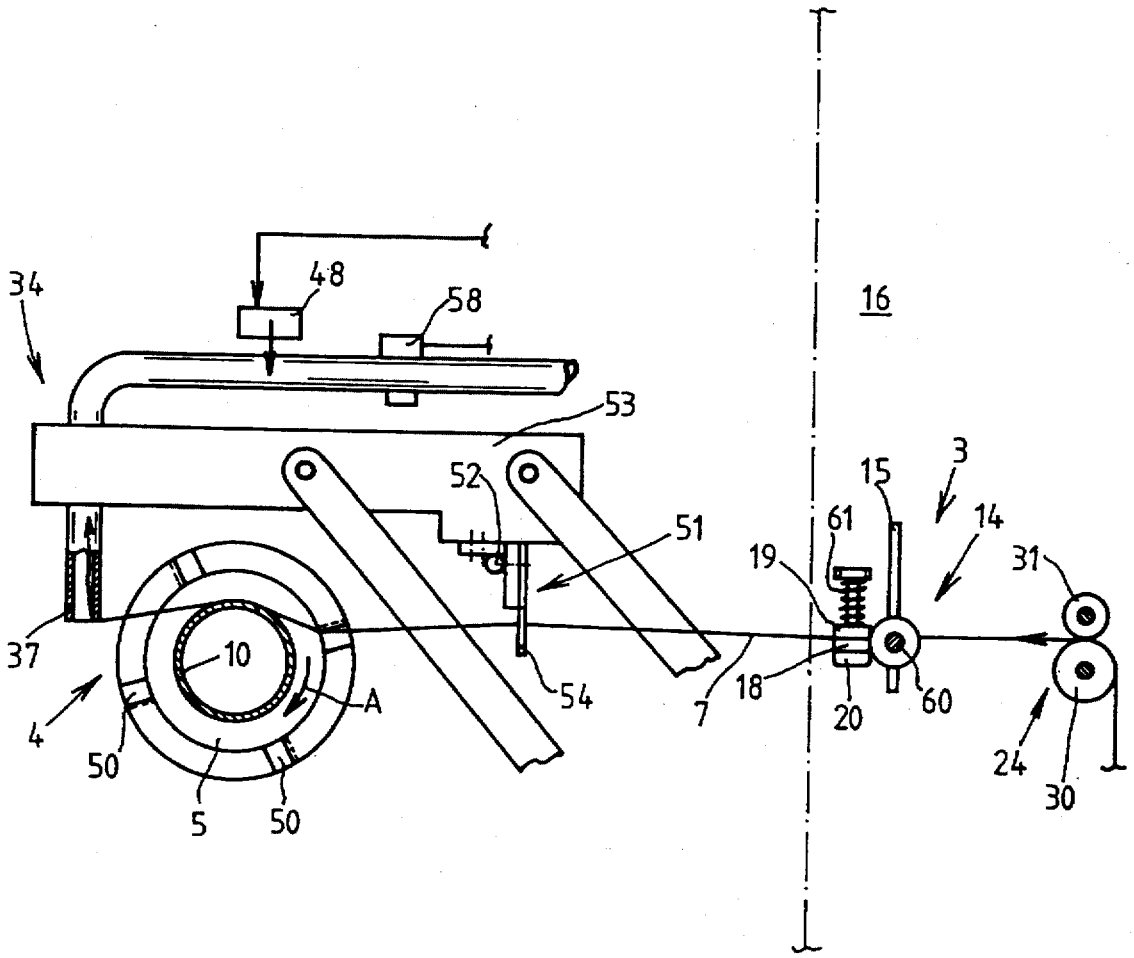
FIG. 7 is a side view of the arrangement of the multi-function element in FIG. 6, viewed in the direction of the arrow VII of FIG. 6.

As shown in FIGS. 6 and 7, the supply tube 37, as swiveled into the forward working position illustrated, then places the yarn 7 against the empty tube 10. The empty tube is retained between two plates 5, 5' of the creel 9 and is rotated in the direction A, having been lowered into peripheral surface contact with the winding drum 11 of the winding device 4.

One of the revolving tube plates 5 is equipped with yarn catcher devices 50. By way of example, these yarn catcher devices 50 comprise slaving grooves, undercut in dovetail fashion, in the region of the outer peripheral edge of the plate. A yarn guide element 51 disposed on the supply tube retainer 53 guides the length of yarn entering the mouth of the supply tube 37 over the tube plate 5 such that it can be engaged by the revolving grooves 50 on the tube plate.

The yarn guide element 51 has an adjustable yarn baffle 54, which by way of example is actuated via a pneumatic drive 52 to enable a defined guidance of the yarn 7 on the empty tube 10. By inward pivoting of the yarn baffle 54, an initial bottom reserve winding 62 is now formed on the empty tube 10. While the yarn reserve winding 62 is being applied, the work head 14 of the multi-function element 3 is moved outwardly in the direction R to a position a shown in FIG. 6, so that a yarn brake 18 disposed on the work head 14 engages and clamps the yarn 7 to keep it taut. Once the yarn reserve winding 62 has been made, the yarn 7 is transferred by the yarn draw-off device 24 of the servicing apparatus 16 to the yarn draw-off device 68 of the spinning machine itself, and simultaneously the multi-function element 3 is returned to its parked position. The replacement/piecing cycle is thus ended and the servicing apparatus 16 is thereby available for a new servicing situation.

Another example of such a servicing situation that requires the intervention of the servicing apparatus 16 is a yarn break. In a yarn break, the servicing apparatus 16 is positioned in front of the affected work station, in the same manner described above, to retrieve the yarn end resting on the surface of the yarn package 8 with its yarn locating nozzle 21 and tension a length of yarn as the yarn locating nozzle 21 pivots rearwardly. This yarn length is then, as also explained above, handled by the yarn piecing devices 25–29 of the servicing apparatus 16 and used for splicing a new yarn.

To prevent parallel windings from being wound onto the yarn package 8 immediately after repiecing of the yarn, i.e., during the run-up phase of the work station before the yarn 7 is under the guidance of the traversal device 6 of the spinning machine itself, the yarn is initially shifted laterally by the multi-function element 3 by means of extending the work head 14 of the multi-function element 3 at a relatively high speed, as indicated in FIG. 3, to the region of the lengthwise center of the bobbin whereat the contoured yarn guide element 15 engages the taut yarn 7 between the yarn package 8 and the yarn draw-off device 24 of the servicing apparatus 16, after which the multi-function element 3 continues to extend at an adapted speed toward the face end 63' of the bobbin to a position b and may possibly then withdraw back to the bobbin middle. As soon as the spinning and winding units of the affected work station have reached their operating rpm and the yarn 7 is again being properly laid by the traversal device 6 of the spinning machine itself, i.e., immediately prior to yarn transfer from the yarn draw-off device 24 of the servicing apparatus 16 to the yarn draw-off device 68 of the spinning machine, the multi-function element 3 is retracted into its initial position. For monitoring the various positions of the multi-function element 3, or for targeted approach to certain work positions, sensor devices 65, 65', etc., are provided, which are connected to the control unit 66 of the servicing apparatus 16.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A servicing apparatus associated with a textile machine for winding yarn to form yarn packages by winding yarn onto a support tube driven by a winding drum, the servicing apparatus including a yarn manipulating device having yarn engagement means for positioning of yarn adjacent a base end of an empty tube and for producing tension in the yarn during formation of bottom windings;

for lateral shifting of yarn parallel to a tube adjacent a surface of wound yarn on the tube following repiecing of a yarn break; and for positioning of yarn adjacent a top end of a full tube for forming top windings, said yarn engagement means comprising a yarn engagement head and drive means for selective movement and positioning of said head parallel to a tube.

2. An improved servicing apparatus for a textile machine according to claim 1 and further comprising a yarn brake mounted to said yarn engagement head.

3. An improved servicing apparatus for a textile machine according to claim 2 wherein said yarn brake includes a spring biased clawing device.

4. An improved servicing apparatus for a textile machine according to claim 3 wherein said yarn brake is disposed on said yarn engagement head at a position sufficient for movement thereof, during transfer of yarn to an empty tube, into a position sufficient for engagement of the yarn by said spring biased clamping device.

5. An improved servicing apparatus for a textile machine according to claim 1 and further comprising a contoured yarn guide mounted to said yarn engagement head.

6. An improved servicing apparatus for a textile machine according to claim 5 wherein said contoured yarn guide includes a tapered yarn engagement surface.

7. An improved servicing apparatus for a textile machine according to claim 5 wherein said contoured yarn guide includes a guide extension projecting outwardly therefrom.

8. An improved servicing apparatus for a textile machine according to claim 1 wherein said yarn engagement head is disposed for traversing the yarn package with said contoured yarn guide in a predetermined manner axially along the surface of the yarn package responsive to operation of said drive means following a yarn break and preparatory to a resumption of winding.

9. An improved servicing apparatus for a textile machine according to claim 5 and further comprising a yarn locating nozzle mounted to a frame of said servicing apparatus for aspirating a yarn end and wherein said contoured yarn guide is configured for movement beyond yarn extending from said yarn locating nozzle to said yarn package during movement of said yarn manipulating device in a first direction along a path of said selective movement and positioning for engagement of said yarn for transport thereof during movement of said yarn manipulating device in a second direction for forming bottom windings.

10. An improved slicing apparatus for a textile machine according to claim 5 and further comprising a package ejection arm mounted to a frame of said servicing apparatus and including a driven roll mounted thereto for engaging the yarn package and imparting rotational movement thereto during transporting movement of the yarn by said contoured yarn guide.

11. An improved servicing apparatus for a textile machine according to claim 1 wherein said drive means for said yarn engagement head includes a fluid driven piston and cylinder assembly operable for said selective movement and positioning of said yarn engagement head, said yarn engagement head being movable traversely to a path of movement associated with the yarn being wound.

12. An improved servicing apparatus for a textile machine according to claim 1 and further comprising at least one sensor operatively connected to said yarn engagement head for sensing a position associated therewith.

* * * * *